United States Patent [19]

Florian

[11] 3,942,671

[45] Mar. 9, 1976

[54] CARRY-OUT TRAY

[75] Inventor: John Florian, Bakersfield, Calif.

[73] Assignee: Mobil Oil Corporation, New York, N.Y.

[22] Filed: Dec. 3, 1974

[21] Appl. No.: 529,159

[52] U.S. Cl. ..... 220/23.8; 206/72; 229/2.5 R; 220/72

[51] Int. Cl.[2] ..... B65D 1/34; A47G 19/00

[58] Field of Search ..... 220/23.8, 72; 206/72; 229/2.5

[56] References Cited

UNITED STATES PATENTS

| | | | |
|---|---|---|---|
| 2,878,932 | 3/1959 | Martire, Jr. | 206/72 |
| 3,295,737 | 1/1967 | Page et al. | 229/2.5 |
| 3,469,686 | 9/1968 | Gutshe et al. | 206/72 |
| 3,493,164 | 2/1970 | Edwards | 229/2.5 |
| 3,498,526 | 3/1970 | Edwards | 229/2.5 |
| 3,578,237 | 5/1971 | Weiss | 220/23.8 |
| 3,638,849 | 2/1972 | Goings | 206/72 |
| R27,688 | 6/1973 | White et al. | 206/72 |

FOREIGN PATENTS OR APPLICATIONS

| | | | |
|---|---|---|---|
| 206,705 | 10/1905 | Germany | 229/2.5 |

*Primary Examiner*—William Price
*Assistant Examiner*—Joseph M. Moy
*Attorney, Agent, or Firm*—C. A. Huggett

[57] ABSTRACT

A tray for food and beverages in which the beverage cup recesses are adapted to retain differing size cups by reason of an arcuate projection from the bottom at one side of such recess.

10 Claims, 10 Drawing Figures

FIG. 1
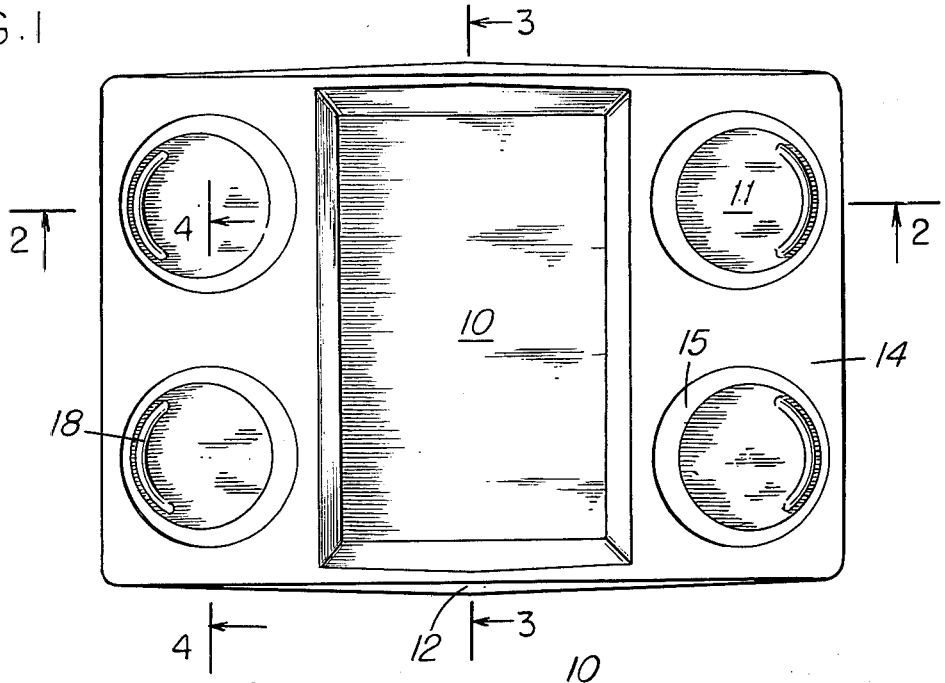
FIG. 2
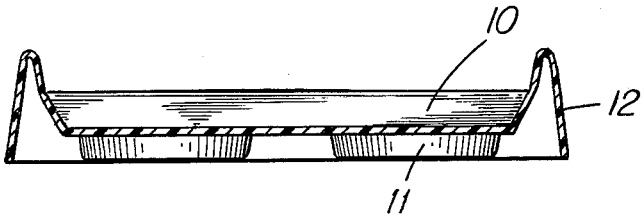
FIG. 3
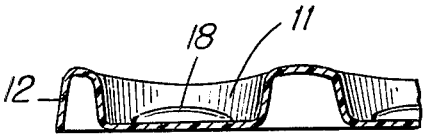
FIG. 4
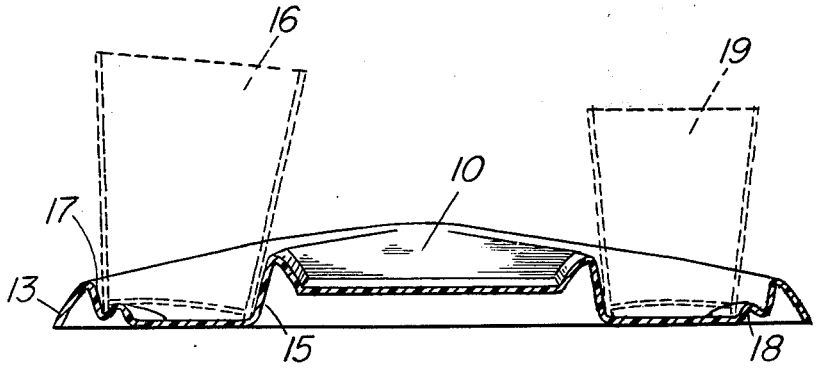
FIG. 5

FIG. 6
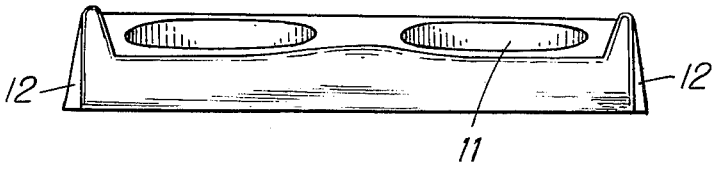
FIG. 7
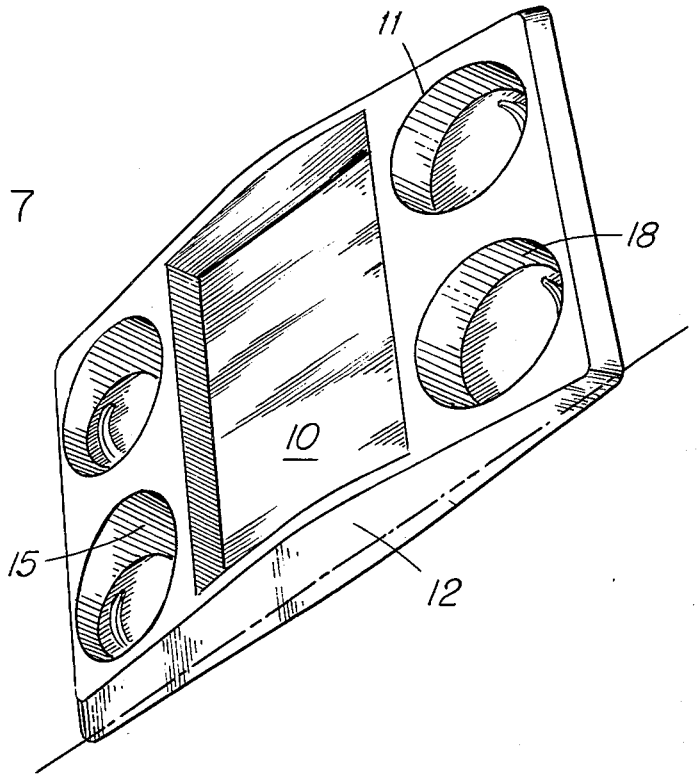
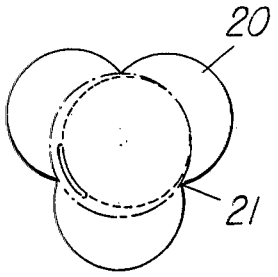
FIG. 8
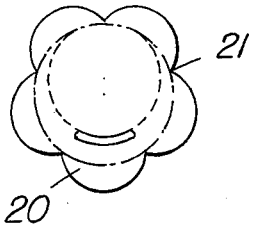
FIG. 9
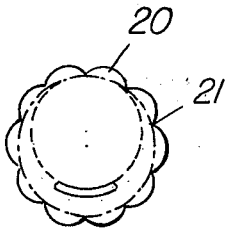
FIG. 10

CARRY-OUT TRAY

BACKGROUND OF THE INVENTION

Merchandising of food for immediate consumption is currently a large and rapidly expanding business. For convenience of the customer, it is usual to provide a cheap, disposable tray of chip board, plastic or the like for carrying sandwiches, snacks and beverages to the point of consumption such as a table, seat of an automobile or picnic blanket. In some arrangements, separate trays are made available for cups of beverage. In others, a single tray is provided with compartments for beverage cups and flat surfaces for support of sandwiches and other solid food.

It is common practice that beverage cup compartments be so formed as to inhibit dislodging or upset of the cups during transport to the point of consumption or while resting on a surface at the point of consumption. The latter consideration can be particularly important when the comestibles are consumed on such precarious surfaces as car seats or blankets. Stability of cups is generally provided by a member spaced above the bottom of the cup retaining area of the tray which bears against the side of the cup.

Because cups of different size are used for different volumes of beverage, it has been necessary to provide alternative trays or to so space the side supports that the cup reception areas will accept the largest cups, with consequent lessened security for smaller cups.

Carry-out trays adapted to consumption in cars, on blankets and other precarious supports are advantageously of a structure which provides a measure of rigidity such that the whole is stabilized. A particularly ingenious system of cross-bracing of such trays is described in U.S. Pat. No. 3,638,849, as a flat blank of plastic provided with hinged flaps and locking devices which can be erected to a stabilized tray particularly adapted for support on the seat of an automobile.

Need exists for a disposable and simple one-piece tray adapted to reception of both liquid and solid comestibles which will retain different size cups with good stability, which is ready for immediate use and which has inherent stability. That need is satisfied and other objects and advantages are provided by a molded carry-out tray shown in the annexed drawings.

DESCRIPTION OF DRAWINGS

FIG. 1 is a plan view of a tray embodying this invention;

FIG. 2 is a longitudinal section on line 2—2 of FIG. 1;

FIG. 3 is a transverse section on line 3—3 of FIG. 1;

FIG. 4 is a partial section on line 4—4 of FIG. 1;

FIG. 5 is a sectional side view in elevation illustrative of the secure mounting of cups of different size;

FIG. 6 is an end elevation of the tray;

FIG. 7 is a perspective view of the tray; and

FIGS. 8, 9 and 10: illustrate modified forms of cup retaining wells.

DESCRIPTION OF SPECIFIC EMBODIMENTS

The tray of this invention is preferably provided with a central rectangular recess 10 adapted to receive sandwiches, potato chips, cakes or other solid comestibles, individually or commonly bagged in paper ("10") bags, flanked on each side by two recesses 11 adapted to receive containers of beverage, soup or other liquid comestible.

Side walls 12 and end walls 13 are formed integrally with an upper surface 14 from which the recesses 10 and 11 depend. The side walls 12 are of triangular form as shown in FIGS. 2, 3 and 7 to provide plates which have the well-known structural strength of that form and provide a longitudinal girder by cooperation with the upper surface 14.

As will be seen in FIGS. 2 and 4, the circular recesses 11 for reception of cups have a relatively high wall 15 on the side thereof adjacent the rectangular recess 10 adapted to bear against the side of a cup 16 held in contact therewith by the relatively low wall 17 of recess 11 adjacent the end of the tray. The recess 11 is formed to have a diameter corresponding to that of the base of a standard large cup 16 which is retained thereby as indicated in FIG. 5.

Spaced inwardly from the low wall 17 of recess 11 is an arcuate projection 18 spaced from the relatively high wall 15 by a distance equal to the bottom diameter of small cups 19, whereby such small cups may be inserted to have the chime resting against the inner surface of projection 18 to hold the side of a small cup 19 against the relatively high wall 15 as shown in FIG. 5.

The projection 18 may be of any desired form, e.g., a round knob, but must be so designed as to fit inside the bottom chime of a large cup 16 to avoid interference with firm retention of such large cups. The arcuate form shown for projection 18 is greatly preferred for the greater security it provides in retention of small cups 19. It is found that an arcuate projection 18 which subtends an angle of about 120° having its apex at the center of the bottom wall of the recess 11 will not interfere with retention of large cups, particularly when the projection 18 has its maximum height at the center thereof as shown and tapers towards its ends to fair in with the bottom of recess 11 at the ends.

The wells are shown in FIGS. 1–6 as circular, but it will be understood that this preferred form is subject to modification, for example, to the multi-lobed forms of FIGS. 8, 9 and 10. The junction of lobes 20, provide projections 21 which bear against and retain the cups. It is only necessary that at least three points of contact be provided, as in FIG. 8.

The tray of this invention is well adapted to manufacture by thermoforming techniques since its surfaces are at angles to permit ready removal from molds. The same feature makes the tray nestable in the sense that a large number of trays may be stacked one on top of the other with each tray engaging adjacent trays to reduce the volume of the stack.

Although it is preferred to manufacture this tray by thermoforming of foamed polystyrene, it can also be prepared by thermoforming of unfoamed plastics, by injection molding or other techniques adapted to thermoplastic materials. The tray can also be made by molding of pulp by techniques well known in the art.

I claim:

1. A molded carry-out tray for food formed with a plurality of circular wells for retention of circular cups having chimes projecting downwardly from the bottoms thereof; the improvement in structure of each of said wells which comprises a flat circular bottom wall, a circular side wall integral with and extending upwardly from said bottom wall and adapted to retain a circular cup in said well, a projection extending upwardly from said bottom wall near an edge thereof and spaced inwardly of said bottom wall from the adjacent portion of said side wall to provide a continued surface of said bottom wall between said projection and the adjacent portion of said side wall adapted to support between the said projection and the said adjacent portion of said side wall the chime of a cup of diameter approximately equal to that of said bottom wall, said projection being further adapted to contact at its surface remote from the side wall with the bottom of a cup of diameter substantially less than that of said bottom wall to thereby retain such cup of lesser diameter in contact with a portion of said side wall remote from said projection.

2. An article of manufacture according to claim 1 in which the said projection is an arcuate segment concentric with said side wall along an interval less than half the circumference of said bottom wall.

3. An article of manufacture accordng to claim 2 in which said arcuate projection subtends an angle of about 120° having its apex at the center of the said bottom wall.

4. An article of manufacture according to claim 1 characterized by a flat central portion flanked by a plurality of said wells on opposite sides of said central portion.

5. An article of manufacture according to claim 2 characterized by a flat central portion flanked by a plurality of said wells on opposite sides of said central portion.

6. An article of manufacture according to claim 3 characterized by a flat central portion flanked by a plurality of said wells on opposite sides of said central portion.

7. An article of manufacture according to claim 4, further characterized by triangular side walls, an upper surface integral with and connecting said triangular side walls, said flat central portion and said wells being constituted by depressed portions of said upper surface.

8. An article of manufacture according to claim 5, further characterized by triangular side walls, an upper surface integral with and connecting said triangular side walls, said flat central portion and said wells being constituted by depressed portions of said upper surface.

9. An article of manufacture according to claim 6, further characterized by triangular side walls, an upper surface integral with and connecting said triangular side walls, said flat central portion and said wells being constituted by depressed portions of said upper surface.

10. An article of manufacture according to claim 9 wherein said cylindrical side walls are higher on the side thereof adjacent said central portion and said arcuate projections are at the side of said wells remote from said central portion.

* * * * *